United States Patent [19]

Hanley

[11] Patent Number: 5,002,282

[45] Date of Patent: Mar. 26, 1991

[54] METHOD OF HAVING A CONCEPT INTEGRATION BOARD GAME

[76] Inventor: Mary Anne Hanley, 428 E. 81st St., Apt. 5B, New York, N.Y. 10028

[21] Appl. No.: 351,445

[22] Filed: May 12, 1989

Related U.S. Application Data

[62] Division of Ser. No. 49,589, Jul. 7, 1987, Pat. No. 4,846,479.

[51] Int. Cl.[5] ..... A63F 3/00

[52] U.S. Cl. ..... 273/236

[58] Field of Search ..... 273/236, 142 R, 284

[56] References Cited

U.S. PATENT DOCUMENTS 3,940,863 3/1976 Kritzberg ..... 273/236

4,684,135 8/1987 Bouchal ..... 273/236

*Primary Examiner*—Edward M. Coven

*Assistant Examiner*—Benjamin Layno

*Attorney, Agent, or Firm*—Kenyon & Kenyon

[57] ABSTRACT

A method of playing a game where players verbally describe relationships between randomly chosen concepts. Each player is randomly given a set of markers representing a wide range of characteristics or facts of nature. Each player places a marker on any space in the playing lattice of the playing board. The first player picks a card which has a statement of physical, mental, physiological, spiritual or emotional characteristics of human beings and natural phenomena. Then that player must use the statment to describe the relation between the first player's placed marker and any other marker on the playing lattice which are inner-connected to the first player's placed marker. An inner-connection being defined as similarly colored lattice spaces connected by similarly colored lines running through the middle portion of the lattice. The other players vote on whether they find the described relationship acceptable. If acceptable, another marker from the first player's set of markers is placed on the playing lattice and play continues to the next player.

8 Claims, 5 Drawing Sheets

PLAYING BOARD

FIG. 3

MAN EMBODIES A WHOLENESS THAT CANNOT BE UNDERSTOOD FROM ANY ONE PARTICULAR PERSPECTIVE.
HaCBoN (mimeo)

AS MAN DEVELOPS, HIS INTERACTION WITH THE ENVIRONMENT ARE INCREASINGLY DIVERSE AND COMPLEX.
NYU PHIL 4

PERCEIVED LINEAR FLOW, ONE WAY, MOVING AT DIFFERENT RATES; A CHANGE IN SENSATION DURING WHICH CYCLICAL EVENTS OCCUR; MANIFESTING AS CONTINUITY.
S,T&M 21

MAN EMBODIES A WHOLENESS THAT CANNOT BE APPROPRIATELY UNDERSTOOD FROM ANY ONE PARTICULAR PERSPECTIVE.
HaBCoPN

THE INTER-PENETRATION/CONNECTION OF 3-DIMENSIONAL SPACE AND TIME, THE ETERNAL NOW.
TOP 154

MAN IS CONTNUOSLY INTERACTING WITH THE ENVIROMENT.
HaCBoNP (mimeo)

4-D IS A CONSTRUCT OF THE MIND, THE SPECIFICATIONS DEPEND ON THE OBSERVER; IS USED BY HIM TO DESCRIBE HIS ENVIRONMENT.
TOP 144

THE REPETITIVE NATURE OF AN IDIVIDUALS PHYSIOLOGIC PATTERNS OCCUR IN A PERIODIC FASHION OR IN . . .
C.H. 12/7/84

WAVE PATTERNING OF THE FIELD TOWARD ACTUALIZATION WITH THE FOCUS ON THE FIELDS MANIFESTATIONS.
NYU PHIL 9

PATTERNS CAN ONLY BE UNDERSTOOD AS A MANIFESTATION OF THE INTERACTION BETWEEN VARIOUS PROCESSES; AS AN OCCURANCE OR EVENT WHICH INTERCONNECTS OTHER EVENTS OR PATTERNS.
TOP 252

MAN IS IDENTIFIED BY HIS MANIFESTED PATTERNS.
NYU PHIL 2

THE CHARACTERISTICS OF THESE ENERGY FIELDS EXHIBIT A FUNDAMENTAL DRIVE TOWARD ORDER AND FORM.
HaCBoNP (mimeo)

FIG. 5A
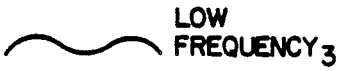
FIG. 5B
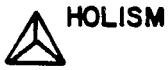
FIG. 5C
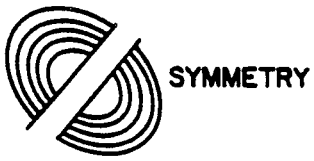
FIG. 5D
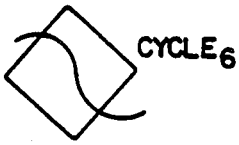
FIG. 5E
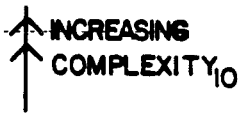
FIG. 5F
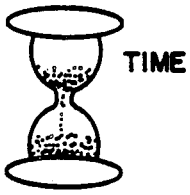
FIG. 5G
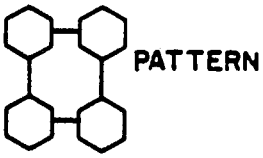
FIG. 5H
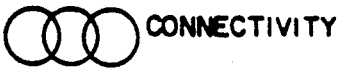
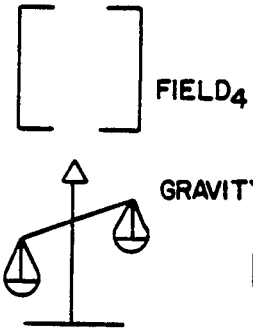
FIG. 5I
FIG. 5J
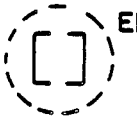
FIG. 5K
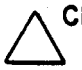
FIG. 5L
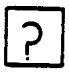
FIG. 5M
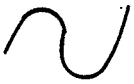
FIG. 5N
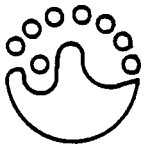
FIG. 5O
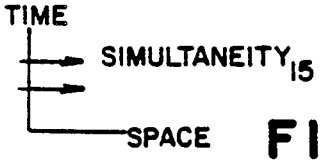
FIG. 5P

METHOD OF HAVING A CONCEPT INTEGRATION BOARD GAME

This is a division of application Ser. No. 07/049,589 filed July 7, 1987, now U.S. Pat. No. 4,846,479.

BACKGROUND OF THE INVENTION

This application relates to an instructional and educational game.

The fields of nursing, psychology, and education sociology, and medicine explore the interrelations of human beings and their environment. These relationships extend along a continuum of health and manifest through interactions, for example, those humans interrelating with electromagnetic fields. Students and scholars immersed in study in such fields often find it instructive to delineate these relationships. However, such study is often redundant, tiresome and lacks a coactive dimension provided by exchange with other students and scholars.

Therefore, it is an object of the present invention to provide a game which will stimulate self-instruction in these fields. Another object is the establishment of a means of study which is both enjoyable and generates interaction with others. Yet another object is the development of a gaming device for educational benefit.

SUMMARY OF THE INVENTION

These and other objects are achieved by the present invention which is directed to a method for playing a game of concept integration. The game includes a playing board, a plurality of markers and a plurality of cards. The board presents a playing surface with a field of outlined spaces comprising a lattice, which fit the markers. The markers indicate by symbols, characteristics or facts of nature and the cards have written on them corresponding descriptions of physical, mental, philosophical, spiritual or emotional characteristics of human beings and natural phenomena.

In particular, the playing board may have a playing lattice of adjoining spaces which cooperatively define the shape of a polygon, each player being allowed to use one or more sides of the polygon. The non-adjoining spaces on this field, i.e. two spaces on the field that are separated from each other by intervening spaces such as Spaces A, B and C of the playing board represented by FIG. 1 are periodically connected through a connecting means. The connecting means can include such device as rows of spaces through the middle of the playing lattice, a series of repeating colors for the spaces themselves, intersecting colored lines through the middle of the lattice or a rotatable disk in the middle of the playing lattice which has multi-colored lines running through its center and to each space. The inter-space connections made by these means are established respectively by the rows, by selecting spaces of the same color, by tracing all lines of the same color leading from the played space to other spaces, these lines being either permanent or mounted on the rotatable disk. For example, non-adjoining Spaces A, B and C shown on the playing board of FIG. 1 are connected through the fact that they are the same color, green. Two of the non-adjoining spaces could as well be connected through the connecting lines of the rotatable disk. Thus, in FIG. 1, green Space A is connected to green Space C through the green (heavy) line on the spinner wheel. Green Space B, however, is not connected to the other green spaces by the spinner. No green line impinges upon the row spaces of with Space B is a part.

In one method of play, the markers are distributed evenly among the players, the players then each randomly place one or more markers on the playing field on a space or spaces of their choice. The first player selects a card, reads the statement and uses the statement to describe the relation between any one of his markers and any or all of the other inner-connected markers i.e., markers on spaces that are connected through means of their being the same color or that are in rows of spaces that are impinged by the same colored line running through the center of the playing field or mounted on a rotatable disk in the center of the playing field. The other players vote on the acceptability of the first player's description for each relation, each yes vote being a point for the first player. If another player (hereinafter the second player) votes no, the second player is required to give his description of the same inner-connection. All other players vote on whose description is better; the first or second player. Votes for the first are points for the first player while votes for the second are points for the second player.

Play continues in repetitive fashion until all markers are on the playing lattice. This ends the game and the winner is the player with the most points.

SHORT DESCRIPTION OF THE DRAWINGS

FIG. 3 depicts some cards with statements.

FIGS. 4 and 5 depict marker symbols for an embodiment of the invention.

DETAILED DESCRIPTION OF THE INVENTION

The inventive game and its method of coactive play provide instruction in certain aspects of medicine, nursing, psychology and sociology. Coactive play provides a vehicle for intellectual synthesis regarding human interactions in these fields. The game allows for exchange among students and scholars in the field while, at the same time, convert what is ordinarily conceived as work, into fun and enjoyment. The variation of marker inter-connections, which is supplied both by the players and the connecting means of the playing board itself, generates a flexibility for the game and avoids production of a single set of marker relationships. The connecting means are in part responsible for this variability.

In one embodiment of the invention, the playing lattice of the playing board has a polygonal shape and a rotatable wheel in its center. The wheel is much like a roulette wheel. It has spokes radiating from its center to each of the spaces forming the perimeter of the polygon. As explained in the foregoing section, the players play one or more markers each on this board. Then the first player draws a card and uses the statement thereon to describe the relation between any of his markers and some or all of the markers to which that player's marker is connected by means of the wheel. The voting procedure for determining acceptability of his description is as given above. At the end of play, the first player spins the wheel to generate a new set of relationships for the next player. Play continues in a repetitive fashion until all markers are on the lattice.

In an alternative embodiment of the game, the game board is a transparency that can be projected on a viewing screen. Cards and markers can as well be projected so that play occurs by moving markers in the projected image.

Figure 1:
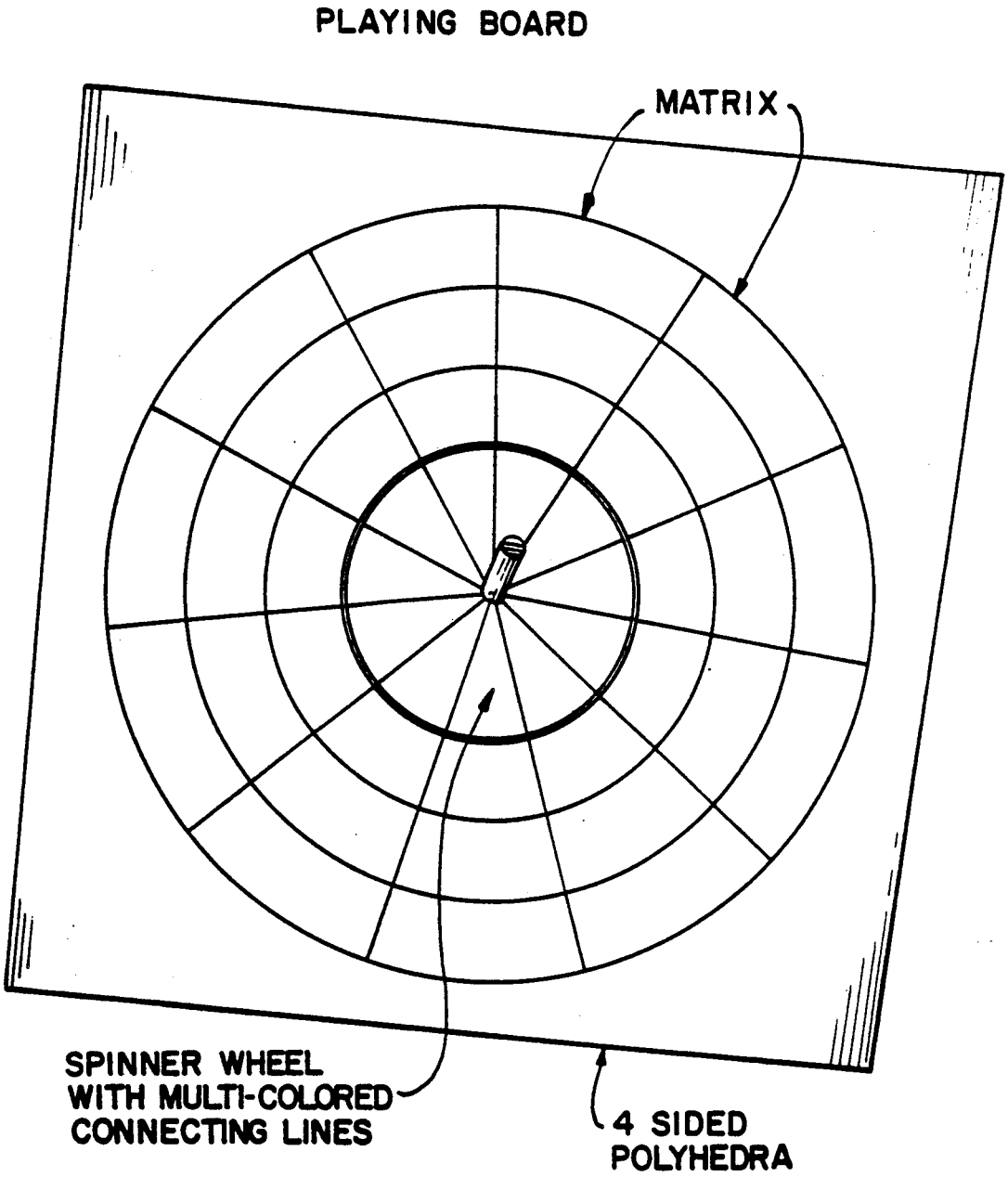
FIG. 1 depicts an embodiment of the playing board for the unitary human game.
Figure 2:
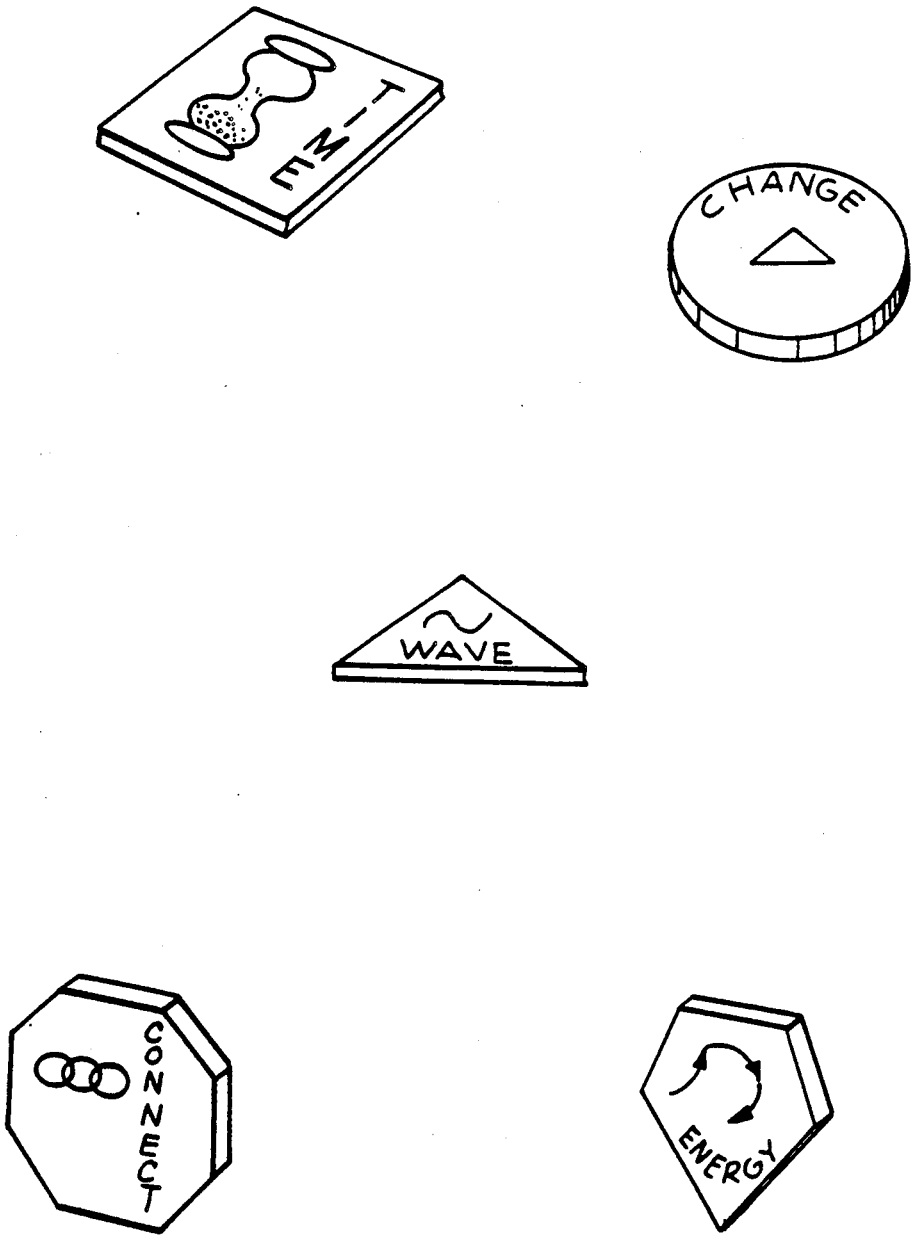
FIG. 2 depicts some markers with symbols.
Figure 4A:
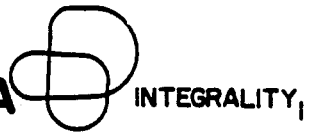
Figure 4B:
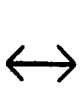
Figure 4C:
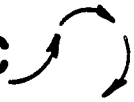
Figure 4D:
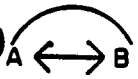
Figure 4E:
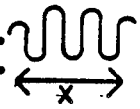
Figure 4F:
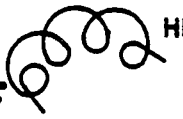
Figure 4G:
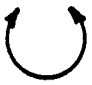
Figure 4H:
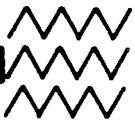
Figure 4I:
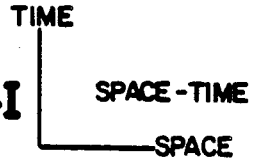
Figure 4J:
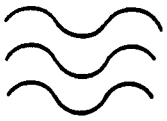
Figure 4K:
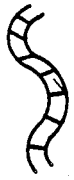
Figure 4L:
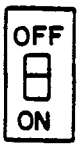
Figure 4M:
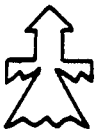
Figure 4N:
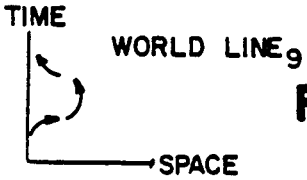
Figure 4O:
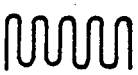
Figure 4P:
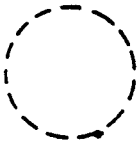
Figure 4Q:
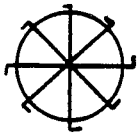
Figure 4R:
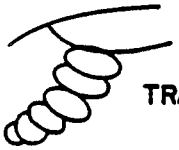

Another embodiment of the game board of this invention is depicted in FIG. 1. Here, the playing surface is set-up as a matrix or lattice of inter-connected spaces. Using this playing lattice, the players describe relationships between their played markers and some or all of those which are on adjoining spaces or those which are closest. Again, the voting procedure is as given in the foregoing discussion.

Using the game board shown in FIG. 1, the following method of play constitutes yet a further embodiment of the game of concept integration.

RULES OF THE GAME

1. The cards are divided into four sets and placed in the large sections within the playing lattice, face down.
2. The markers are placed face down on the table.
3. Each player chooses three (3) markers, examines them, and may lay them face up or keep the contents private (player's choice).
4.
   a. Games with a single player progresses as the player selects cards from the lattice in a clockwise order.
   b. Games with two players progress as players alternate after completion of a turn. Players in games of two or more may select cards from any of the four (4) piles.
   c. Games with three or more players progress in a clockwise motion, again, players may choose from any pile of the four.
5. The first player selects a card, relates the definition or concept description to the markers previously selected.
6. The first player places one or more of the markers on the playing board at any point and in any direction so long as the inter-relation of the markers symbolizes the player's perception of the intent or content of the card.* Markers must be placed on any space of the lattice.

Markers may symbolize abstractions of definitions; creativity and imaginitivity are integral with the game process and encourage innovative synthesis of concepts presented. These innovations yield an increased diversity and complexity in each players thought processes and applications to reality.

7. The player verbalizes the connections between the card, his placed marker, and his placed relation to the markers placed by the other players.
8. A turn is completed when a player has described or answered the statement chosen.
9. Players are encouraged to discuss with each other the possible placement of markers; the effect of placement in relation to the existing concepts; and determine the predictable, probable relationships with the as yet unidentified concepts (cards).
10. At the completion of a turn the player chooses additional marker(s) to complete the series of three (3).
11. The next player, and each successive player, carries out the same process, with the addition of one factor, players may choose to place their markers in conjunction with markers already on the board or may place them independent of the markers already on the board. (The ability to expand upon concepts through the use of existing symbols and to relate their interconnectivity is a main function of the game process.)
12. Play continues until all markers have been utilized and/or all cards have been demonstrated on the playing board.
13. If a player selects a card that does not relate to markers previously chosen, the player may:
    a. select another card from a pile after replacing the unused card at the bottom of any pile of cards, or
    b. extrapolate, from the card to markers or the reverse, information about the interpretation of the concepts symbolized and described by the cards and markers.

As mentioned in the Summary of the Invention, the markers symbolize characteristics or facts about the natural and phenomenological world. Illustrations of such symbols are given in FIGS. 4 and 5. The following Table 1 summarizes these symbols.

TABLE 1

| FIG. | Representation | FIG. | Representation |
|---|---|---|---|
| 4A | Integrality | 5A | low frequency |
| 4B | Mutual Simultaneous Intraction | 5B | Holism |
| 4C | Energy | 5C | Symmetry |
| 4D | Cause - Effect | 5D | Cycle |
| 4E | Wave Packet | 5E | Increasingly Complex |
| 4F | Helicy | 5F | Time |
| 4G | Complementary | 5G | Pattern |
| 4H | Synchrony | 5H | Connectivity |
| 4I | Space-Time | 5I | Field |
| 4J | Resonancy | 5J | Gravity |
| 4K | DNA | 5K | Environment |
| 4L | Power Control | 5L | Chance |
| 4M | Emergent | 5M | Change |
| 4N | World line | 5N | Wave Phenomenon |
| 4O | High Freqency | 5O | Unitary Human |
| 4P | Openness/Human Field | 5P | Simultaneity |
| 4Q | Motion | | |
| 4R | Transportation | | |

1. Two events occurring at the same time, may be viewed by observers in relation to themselves and appear differently.
2. The continuous, mutual, simultaneous interaction between human and environmental fields.
3. The mutuality of change that occurs through the interaction and exchange of energy.

The cards used in the game of concept integration describe characteristics of human beings or natural phenomena. These include chemical, biological, physical, metaphysical, social, environmental, psychological, spiritual, biochemical, and the like. Illustrations of statements that may be used are as follows:

1. Two events occurring at the same time, may be viewed by observers in relation to themselves and appear differently.
2. The continuous, mutual, simultaneous interaction between human and environmental fields.
3. The mutuality of change that occurs through the interaction and exchange of energy.
4. An energy field identified by pattern, and encompassing all that is outside any given human field.
5. What is the unifying concept of human beings and environment?
6. A human being's movement is singularly future oriented.

7. The human field and the environmental field are identified by wave patterns which change from lower frequency to higher frequency patterns.

8. Change in the human field depends upon the state of the human field and the simultaneous state of the environmental field.

9. Human beings and the environment change and are changed by each other, expressing patterns that are characteristic of that change.

10. Energy fields are infinite and continuously open.

11. What characterizes the human field and energy field, is always changing and emerges increasingly diverse?

12. The path of a particle through space-time can move forward or back in space but can only move forward in time.

13. Human beings and the environment are energy fields, each is an open system, integral with the other, yet manifesting its own integrity.

14. Proportion depends upon the agreement among the parts and is determined by their relation to the whole and to each other.

15. Patterns emerge out of continuous, mutual simultaneous interactions, and manifest in non-repeating rhythmicities.

16. Universal laws are structured such that events have the same form in all coordinate systems for all observers in arbitrary positions and relative motion.

17. The ability to participate knowingly in change.

18. What is the fundamental unit of unitary human beings and the environment.

19. The irreducible nature of individuals as different from the sum of the parts.

20. The nature and direction of human and environmental change are continuously innovative, probabilistic, and characterized by increasing diversity.

21. Patterns are emergent, unprecedented and innovative.

22. The double helix which comprise a human being's genetic material, wherein exists the blueprint for the patterns of life function and form.

23. What is aspatial, atemporal, and manifests as the relative present in space-time.

24. Bodies combine their energy to produce a force which is attractive to other bodies; influences space so that other bodies feel the force and effects of that space.

25. The effects of gravity and electromagnetic interaction on space effects changes in the shape of space: space is curvi-linear.

26. Change proceeds in the direction of higher frequency which increases in motion and complexity.

27. Two events occurring at the same relative present time, moving in the same direction at the same speed.

The foregoing description of the invention is meant as an illustration of the embodiments thereof rather than as a limitation. The following claims set forth the invention.

What is claimed is:

1. A method of playing a game of concept integration comprising the following sequential steps of:

(A) distributing among at least two players a group of markers, each marker having indicated thereon a symbol of a physical property;

(B) each player placing one marker from his group, upon a space on a playing board, said playing board having a playing lattice of adjoining outlined spaces which cooperatively define the shape of a polygon, the non-adjoining spaces being periodically inner-connected by connecting means;

(C) the first player picking a card from a group of cards having thereon a statement of a physical, mental, emotional, spiritual or philosophical characteristic of humans;

(D) the first player using the statement on the picked card to describe the relation between said player's placed marker and any other markers on the playing lattice which are inner-connected to said player's placed marker;

(E) the other players voting yes or no as to whether they accept the relation described by the first player, each yes vote being one point for the first player;

(F) each player voting no in step E) describing their perception of the statement on the card picked by the first player in relation to the first player's marker and any of the inner-connected markers;

(G) the other players including the first player, vote yes or no as to whether they accept the description of the no voting player of step (F) as more reasonable than the description given by the first player, each yes vote being one point for the novoting player, each no vote being one point for the first player;

(H) the first player thereafter selecting at least one more marker from his group of markers and placing it on a space of the playing lattice, the first player's turn thereby ending;

(I) repeating steps (C) through (H) for each of the subsequent players until all markers in each player's group are on the playing lattice;

(J) Summing the points accumulated by each player, the player with the highest total being the winner.

2. A method according to claim 1 wherein the middle of the playing lattice of the play board is free of spaces and the spaces define a continuous path around the perimeter of the polyhedra.

3. A method according to claim 2 wherein the connecting means are colored lines running through the middle of the playing lattice and intersecting its center.

4. A method according to claim 2 wherein the connecting means are the colors of the spaces which make a repetitive pattern such that non-adjoining spaces are periodically the same color.

5. A method according to claim 2 wherein the connecting means is a rotatable disk mounted on a pin, the outer perimeter of the disk being coterminus with the inner perimeter of the polyhedra, the disk having a plurality of colored lines running along the disk diameters which are distributed radially to provide one line per space.

6. A method according to claim 5 further comprising the step of spinning the disk after each round of play by the players.

7. A method according to claim 2 wherein the markers have symbols representing the principles and basic facts of physics, chemistry, biology and other natural phenomena.

8. A method according to claim 2 wherein the statements describe physical, mental, philosophical, spiritual or emotional characteristics about human beings.

* * * * *